US008074706B2

(12) United States Patent
Su et al.

(10) Patent No.: US 8,074,706 B2
(45) Date of Patent: Dec. 13, 2011

(54) HEAT SPREADER WITH COMPOSITE MICRO-STRUCTURE

(75) Inventors: Cherng-Yuh Su, Taipei (TW); Kuo-Ying Lee, Sindian (TW); Chien-Hung Liin, Taipei (TW)

(73) Assignee: Taiwan Microloops Corp., Taipei (TW)

( * ) Notice: Subject to any disclaimer, the term of this patent is extended or adjusted under 35 U.S.C. 154(b) by 197 days.

(21) Appl. No.: 11/738,108

(22) Filed: Apr. 20, 2007

(65) Prior Publication Data

US 2007/0295486 A1 Dec. 27, 2007

(30) Foreign Application Priority Data

Apr. 21, 2006 (TW) ..... 95206851 U

(51) Int. Cl.
*F28F 7/02* (2006.01)

(52) U.S. Cl. ..... 165/104.26; 165/185; 165/80.3

(58) Field of Classification Search ..... 165/80.3, 165/104.26, 185
See application file for complete search history.

(56) References Cited

U.S. PATENT DOCUMENTS

| | | | | |
|---|---|---|---|---|
| 5,325,913 | A * | 7/1994 | Altoz | 165/287 |
| 6,082,443 | A | 7/2000 | Yamamoto et al. | |
| 6,269,220 | B1 | 7/2001 | Jeong et al. | |
| 6,282,367 | B1 | 8/2001 | Cho et al. | |
| 6,745,349 | B1 | 6/2004 | Suzuki et al. | |
| 7,043,477 | B2 | 5/2006 | Mercer et al. | |
| 7,055,082 | B2 | 5/2006 | Mori et al. | |
| 7,346,830 | B2 | 3/2008 | Freissmann et al. | |
| 7,523,214 | B2 | 4/2009 | Kikkawa et al. | |
| 2003/0159806 | A1 * | 8/2003 | Sehmbey et al. | 165/80.3 |
| 2006/0213061 | A1 * | 9/2006 | Wu et al. | 29/890.032 |

FOREIGN PATENT DOCUMENTS

| | | |
|---|---|---|
| CN | 1668886 | 9/2005 |
| CN | 1672258 | 9/2005 |
| JP | 7-208884 | 8/1995 |
| TW | 516808 | 8/1990 |
| TW | I 235906 | 2/1992 |
| TW | I 293361 | 5/1992 |

(Continued)

OTHER PUBLICATIONS

Chang, H-C. et al., "A Reed-Solomon Product-Code (RS-PC) Decoder for DVD Applications", Paper SP 24.7 XP-000862225, (1998) IEEE.

*Primary Examiner* — Teresa J Walberg
(74) *Attorney, Agent, or Firm* — Holland & Knight LLP; Brian J Colandreo, Esq.; Jeffrey T. Placker

(57) ABSTRACT

A heat spreader comprising a casing, a micro-structure layer, a support device, and a working fluid is provided. The casing has an inner surface and is defined by a sealed chamber where the working fluid circulates therein. The micro-structure layer is formed on the inner surface of the casing, wherein the micro-structure layer comprises a first structure layer which is formed by the first metallic mesh. Specifically, the first metallic mesh forms the first structure layer on the inner surface through diffusion bonding so that the working fluid can circulate within the micro-structure layer by capillary action. In addition, the support device is disposed in the sealed chamber for supporting the casing. Thus, a heat spreader with a composite micro-structure can not only enhance the capillarity but also reduce the flowing resistance during operation.

19 Claims, 7 Drawing Sheets

FOREIGN PATENT DOCUMENTS

| | | | |
|---|---|---|---|
| TW | I 284190 | | 11/1993 |
| TW | 200523518 | | 12/1993 |
| TW | 557350 | | 10/2003 |
| TW | 577537 | | 2/2004 |
| TW | 200427962 | | 12/2004 |
| TW | I 253263 | | 8/2006 |
| WO | WO2004/036644 | * | 4/2004 |
| WO | 99/57724 | | 11/2009 |

* cited by examiner

HEAT SPREADER WITH COMPOSITE MICRO-STRUCTURE

This application claims the befits of priority based on Taiwan Patent Application No. 095206851 filed on Apr. 21, 2006; the disclosures of which are incorporated by reference herein in their entirety.

RELATED APPLICATIONS

Not applicable.

TECHNICAL FIELD

The present invention relates to a heat spreader. In particular, the invention relates to a heat spreader with a composite micro-structure.

BACKGROUND

Descriptions of the Related Art

In current electronic apparatuses, such as personal computers, communication devices, or thin-film-transistor liquid crystal displays, many electronic components that may generate heat during operation are used. Inevitably, as operation speed is increased, more heat is generated from the electronic apparatus. Therefore, it is important to prevent the electronic apparatus from overheating so that efficiency is not thereby, reduced. Thus, various cooling devices and methods for use in electronic apparatuses have been developed.

For example, a cooling device with a heat pipe attached onto the cooper sheets has been disclosed. However, because the heat pipe can not work independently, another flat type heat pipe, also known as "heat spreaders," has been developed. The heat spreaders can be independently operated and are able to efficiently cool the apparatus. For these reasons, heat spreaders have been used frequently in the industry.

Generally, a conventional heat spreader is made of cooper plates which form a sealed and vacuumed hollow casing. A working fluid is introduced therein. In particular, capillary structures are formed on the inner surface of the casing. Due to the vacuum, the working fluid will vaporize rapidly when heat is absorbed from the heat source area. When the vapor discharges the heat in the heat distributing area, the vaporized working fluid will condense into the liquid state and then flow back to the heat source area through the capillary. This heat absorbing-distributing cycle is then repeatedly performed.

In practice, when the capillary action between the capillary structure and the working liquid is enhanced, the heat transmitting capability of the heat spreader can be effectively improved. Conventionally, it is difficult to both enhance the capillarity and reduce the flowing resistance at the same time. That is to say, when a capillary structure with smaller cavities is adopted to enhance the capillarity, a higher flowing resistance will be generated to impede the circulation of the working fluid. When a capillary structure with larger cavities is adopted to reduce the flowing resistance and facilitate the circulation of the working fluid, the capillarity is not as effective.

Conventionally, micro-grooves, cooper meshes or sintering cooper powder, are used to form the capillary structure of the heat spreader. However, the conventional structure can merely be formed with cavities of the same size. Accordingly, the conventional structure can not simultaneously satisfy the two considerations.

Given the above concerns, it is important to develop a novel heat spreader with a composite micro-structure.

SUMMARY OF DISCLOSURE

The primary objective of this invention is to provide a heat spreader with a novel composite micro-structure. The heat spreader of the present invention can not only enhance the capillarity but can also reduce the flowing resistance during operation. In other words, the inverse relationship between the capillarity and the flowing resistance in the convention can be resolved.

Another objective of this invention is to provide a heat spreader with a novel composite micro-structure. After the mesh is treated with a diffusion bonding process, the micro-structure is formed on the inner surface of the heat spreader. Thus, the structure that facilitates the heat-exchange circulation in the heat spreader is constructed.

To achieve the aforementioned objectives, the heat spreader of the present invention comprises a casing, a micro-structure layer, a support device, and a working fluid. The casing has an inner surface and is defined by a sealed chamber where the working fluid circulates therein. The micro-structure layer is formed on the inner surface of the casing, wherein the micro-structure layer comprises a first structure layer which is formed with a first metallic mesh. Specifically, the first metallic mesh forms the first structure layer on the inner surface by diffusion bonding so that the working fluid can circulate within the micro-structure layer by capillarity. In addition, the support device is disposed in the sealed chamber for supporting the casing.

The present invention also discloses a micro-structure manufactured from a mesh. The mesh consists of a plurality of metallic wires which are respectively arranged along two perpendicular orientations. The metallic wires are combined through diffusion bonding to form the micro-structure.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENTS

The so-called "mesh" hereinafter implies a substantial structure or the measurement of the structure interwoven by wires. Those skilled in the art can certainly comprehend the expression.

Figure 1:
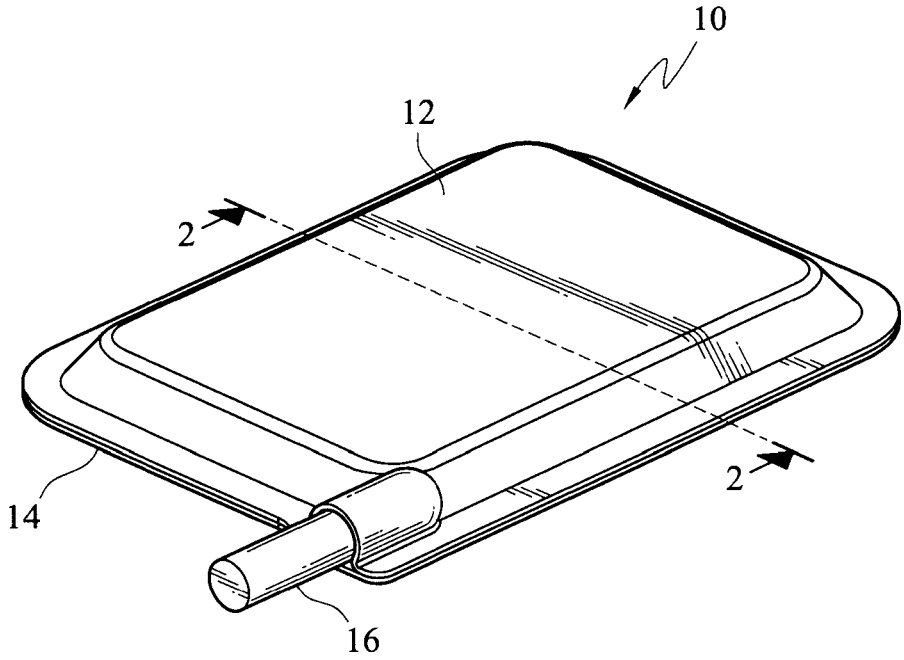
FIG. 1 is a schematic view illustrating the heat spreader of the present invention.

As shown in FIG. 1, an embodiment of the heat spreader 10 of the present invention is illustrated. Generally, the heat spreader 10 is flat and comprises an upper cover 12, a lower cover 14 and an introducing tube 16. Conventionally, the heat spreader 10 and the components are usually made of copper or any other metal with high conductivity, such as aluminum. The upper cover 12 and the lower cover 14 can be integrated using various conventional manufacturing processes, such as welding, diffusion bonding and etc., to form the casing. The casing, formed preferably by copper or aluminum, has an inner surface and is defined with a sealed chamber 13 therein. As shown in FIG. 2, a vacuum is formed and a working fluid, such as water (not shown), is contained in the sealed chamber 13. The introducing tube 16, which is used to introduce the working fluid into the chamber 13, has one end connected to the chamber 13 and the other end sealed after the fluid has been added.

Figure 2A:
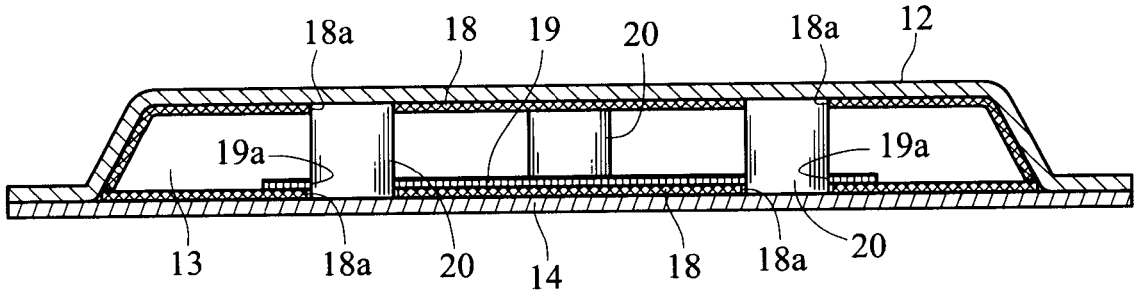
FIG. 2A is a cross-sectional view illustrating the first embodiment of the present invention along the A-A line in FIG. 1.
Figure 2B:
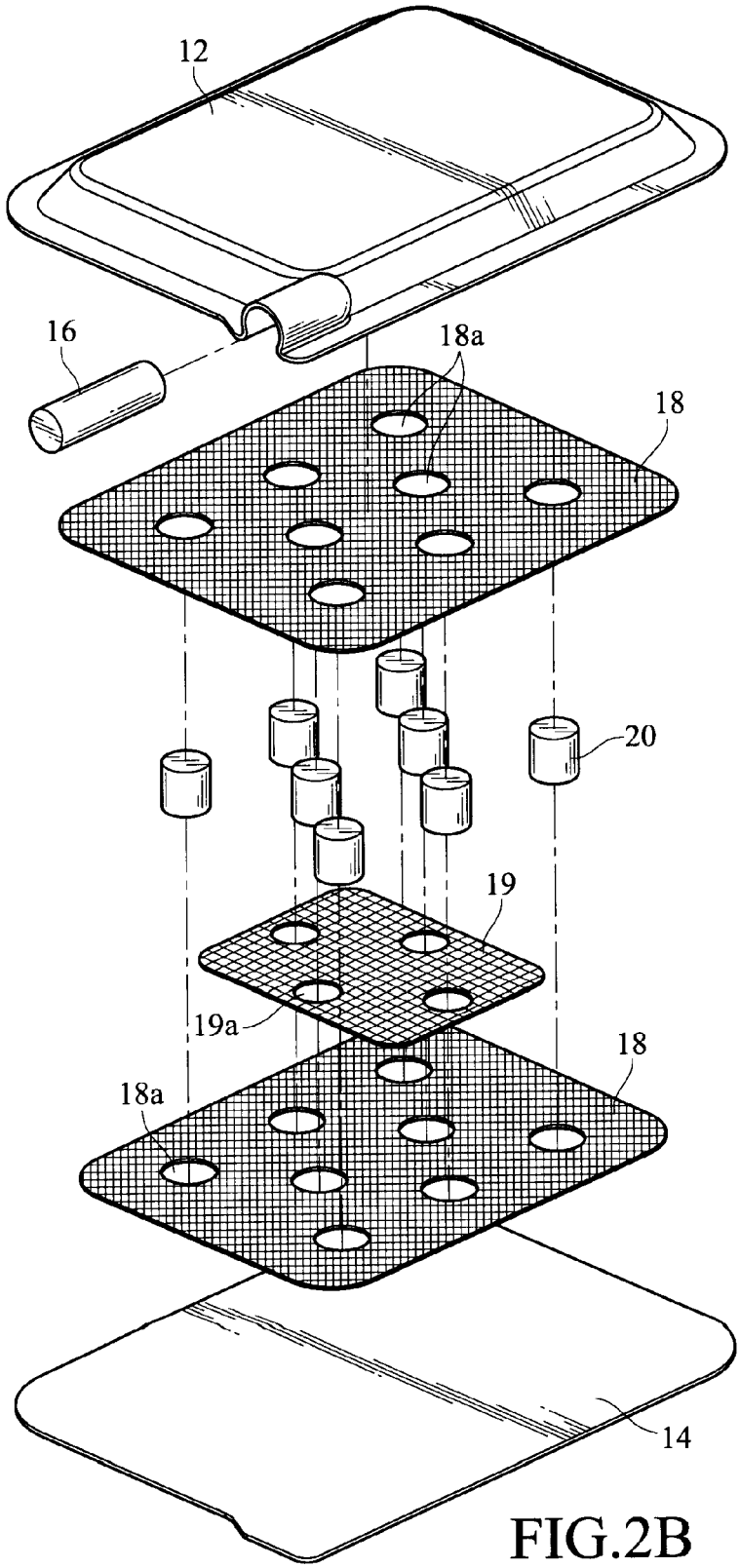
FIG. 2B is an exploded view illustrating the heat spreader in FIG. 2A.

The first embodiment of the micro-structure layer formed on the inner surface of casing is shown in FIG. 2A and FIG. 2B. The micro-structure which is made of a copper mesh in the embodiments thereinafter can also be made of any other suitable metal, such as aluminum, without any changes to the structure. The copper meshes hereinafter are disclosed for illustration convenience.

The first metallic mesh 18, or namely, the first structure layer, is substantially formed on all the surfaces of the chamber 13 as a capillary structure for the working fluid circulating therein. The first metallic mesh 18 can be applied using various conventional manufacturing processes, such as welding or diffusion bonding, to attach onto the surface. In the present invention, diffusion bonding is preferably used to form the first structure layer. The second metallic mesh 19, or namely, the second structure layer, is disposed on the first metallic mesh 18 on the lower cover 14 in this embodiment. The second metallic mesh 19 is smaller than the first metallic mesh 18. When the first metallic mesh 18 and the second metallic mesh 19 are combined to form the composite capillary micro-structure of the heat spreader 10, the cavities of the second structure layer are smaller than that of the first structure layer. Similarly, various conventional manufacturing processes, such as welding and diffusion bonding, can be used to combine the second metallic mesh 19 and the first metallic mesh 18. It is noted that the "cavities" of the meshes referred to herein, are of average size.

A plurality of openings 18*a* can be formed on the first metallic mesh 18. These openings are used to contain both the ends of the copper columns 20 and thus the copper columns 20 combine with the inner surface of the upper cover 12 and lower cover 14 by diffusion bonding. In this case, the openings 19*a* that correspond to the openings 18*a* should be formed on the second metallic mesh 19. The columns 20 disposed in the sealed chamber 13 are used to support the casing of the heat spreader 10 and to prevent the deformation on the casing when the working fluid vaporizes or condenses. It is noted that the openings 18*a* and 19*a* are preferably, but not necessarily, disposed in this embodiment. Furthermore, to enhance the circulation of the working fluid, the surface of the copper columns can be treated with a mechanical or chemical roughened process, such as grooving, sand blasting or chemical etching (not shown in the figures).

In this first embodiment, the second metallic mesh 19 and the covered portion of the first metallic mesh 18 are integrated to form a portion of the micro-structure in the vaporization area (i.e. the heat source area) of the heat spreader 10. The uncovered portion of the first metallic mesh 18 is disposed in the condensation area (i.e. the heat dissipating area) and the transportation area of the heat spreader 10. More specifically, the vaporization area usually contacts with the heat source, such as a central processing unit (CPU). When the working fluid absorbs the heat generated from the heat source in the vaporization area, it will be subsequently vaporized. Then, the vapor will condense into the liquid state after the heat is dissipated in the condensation area. The working fluid in the liquid state will flow back to the vaporization area and repeatedly circulate.

Because the second metallic mesh 19 (i.e. the upper layer of the micro-structure on the vaporization area) has smaller cavities compared to those of the first metallic mesh 18, the second metallic mesh 19 has a stronger capillarity which keeps the working fluid in the vaporization area until complete vaporization. On the other hand, the first metallic mesh 18, including the portion covered by the second metallic mesh 19 (i.e. the layer under the second metallic mesh 19 on the vaporization area) and other portions on the condensation area and transportation area with larger and identical cavities will circulate the working fluid from the condensation area to the vaporization area. As a result, the heat dissipating capability of the heat spreader 10 is enhanced.

Those skilled in the art can certainly understand that the second metallic mesh 19 can be substituted with a sintered metallic layer, such as a copper sintered layer.

Figure 3A:
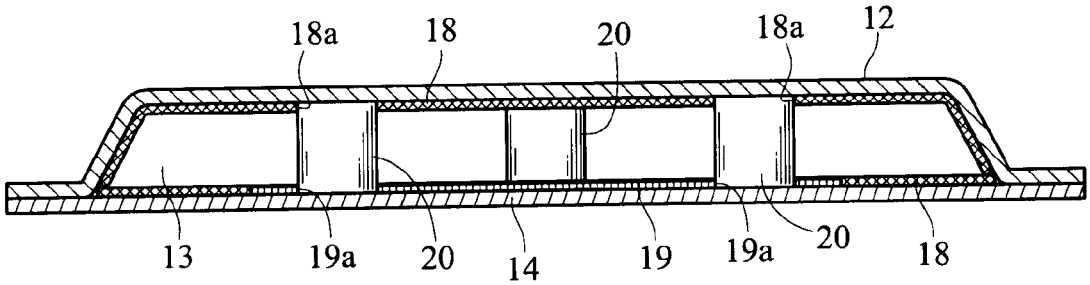
FIG. 3A is a cross-sectional view illustrating the second embodiment of the present invention along the A-A line in FIG. 1.
Figure 3B:
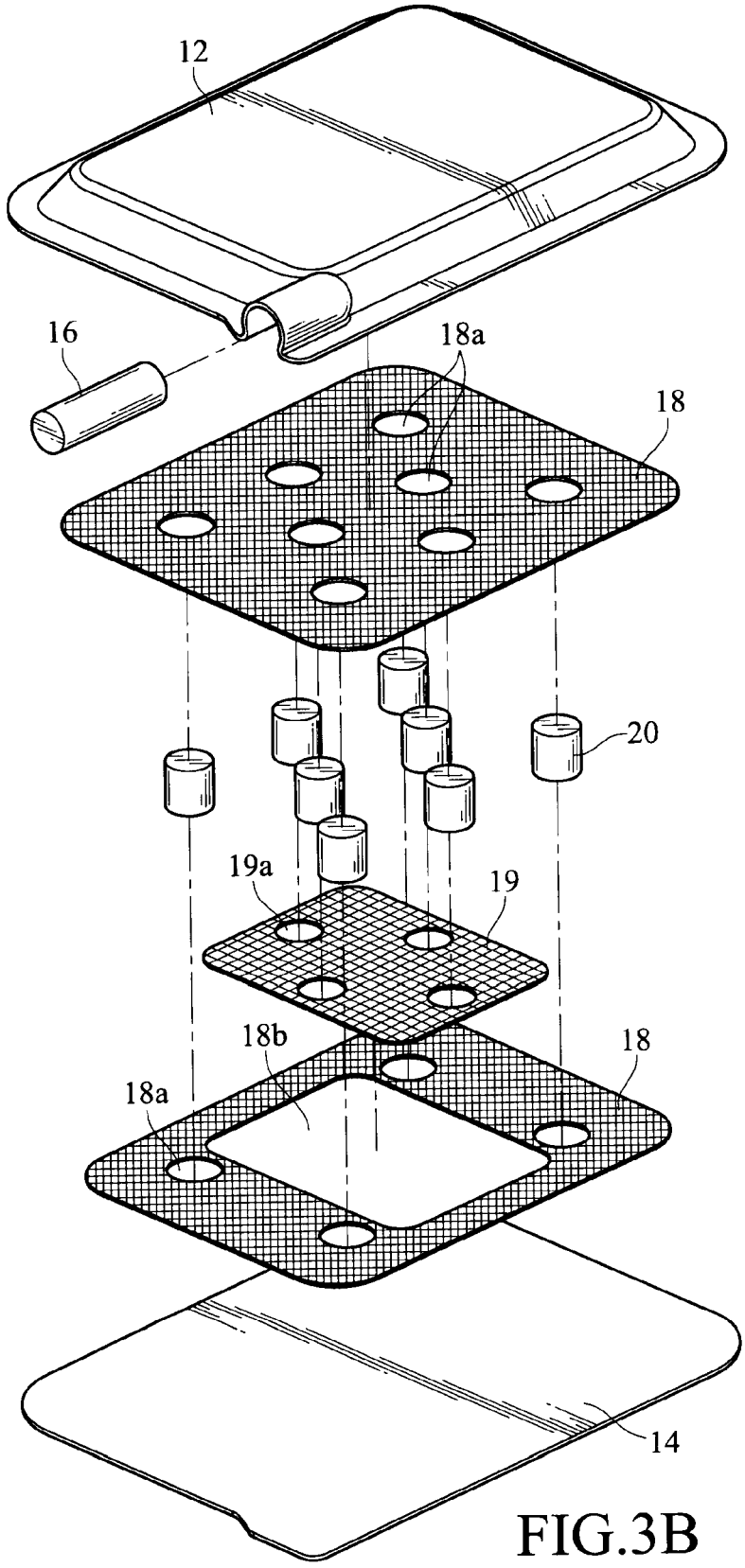
FIG. 3B is an exploded view illustrating the heat spreader in FIG. 3A.

In the first embodiment, the second metallic mesh 19 is stacked onto the first metallic mesh 18, preferably, at different orientations. However, in the second embodiment of the present invention as shown in FIG. 3A and FIG. 3B, the meshes can be integrated without stacking. Compared to the first embodiment, the meshes in the second embodiment have different dispositions, but are similar in cavity size and operation.

In the second embodiment, an opening 18*b* corresponding to the vaporization area is formed on the first metallic mesh 18 to fit the second metallic mesh 19. The second metallic mesh 19 can be embedded within the opening 18*b* and comes into contact with the first metallic mesh 18 at the periphery. Furthermore, the meshes 18 and 19 can both attach onto the inner surface of the lower cover 14. In other words, the first metallic mesh 18 and the second metallic mesh 19 are disposed on the same surface to ensure transportation (as shown in FIG. 3A).

Figure 4:
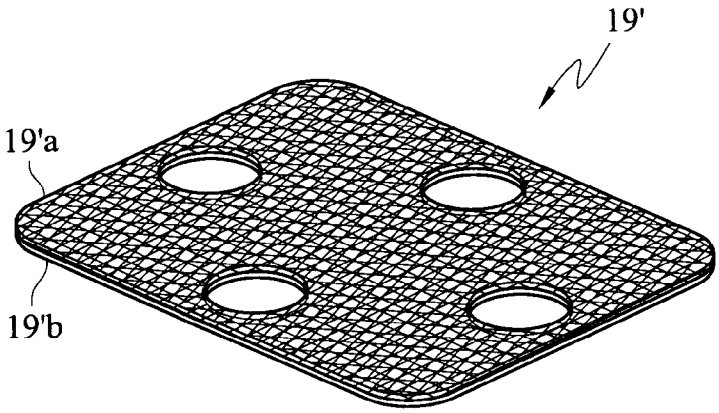
FIG. 4 is a schematic view illustrating the second metallic mesh 19'.
Figure 5:
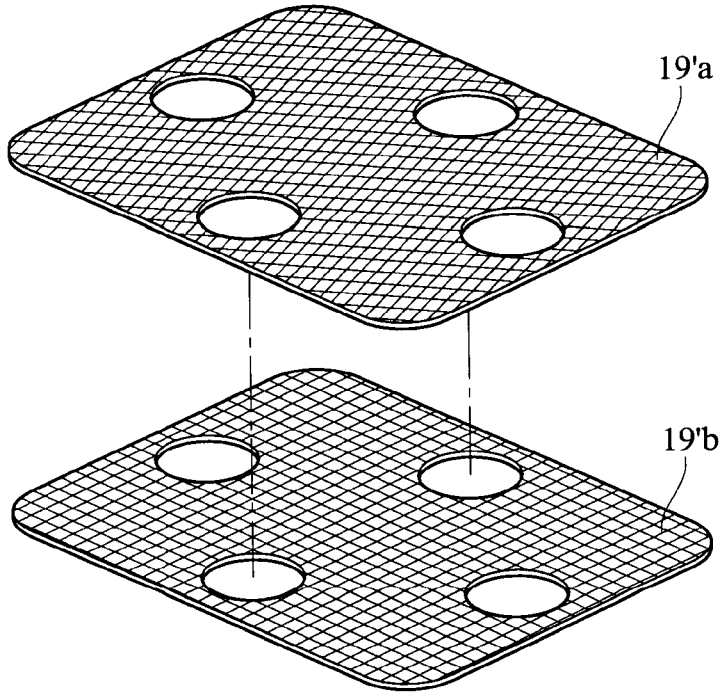
FIG. 5 is an exploded view illustrating the mesh as shown in FIG. 4.

In the embodiments as shown in FIGS. 2A, 2B, 3A and 3B, a single mesh 19 is disclosed. Certainly, a plurality of meshes can be applied in the present invention. As shown in FIG. 4 and FIG. 5, two meshes 19'*a* and 19'*b* are stacked to form the second metallic mesh 19'. In this case, the meshes 19'*a* and 19'*b* can have differently or similarly sized cavities. Preferably, the meshes 19'*a* and 19'*b* should be stacked at different orientations to form the second metallic mesh 19' with smaller cavities. If needed, several meshes can be stacked with each other to produce a micro-structure layer with smaller cavities.

According to the aforesaid embodiments, the micro-structure of the heat spreader 10 includes, but is not limited to, the first metallic mesh 18 and the second metallic mesh 19 with differently sized cavities. For example, the micro-structure can further comprise a structure layer made of a metallic sintered powder or manufactured by a roughening process (not shown in the figures). More specifically, the metallic powder is made of copper or aluminum, and the roughening process can either be mechanical or chemical, such as grooving, sand blasting or chemical etching.

Figure 6:
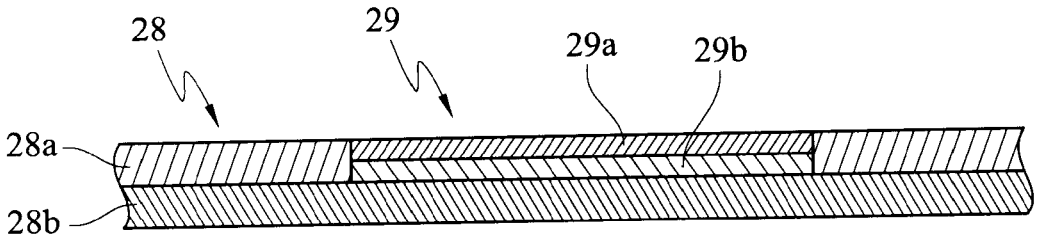
FIG. 6 is a cross-sectional view illustrating a preferred embodiment of the present invention.

FIG. 6 is a cross-sectional view illustrating a preferred embodiment of the present invention. In this embodiment, the first structure layer 28 is formed with at least two first metallic meshes 28*a* and 28*b*, while the second structure layer 29 is formed with at least two second metallic meshes 29*a* and 29*b* by diffusion bonding. In actuality, the cavity size of the second structure layer 29 is smaller than that of the first structure layer 28. For example, the first metallic meshes 28*a* and 28*b* are sized with 200 meshes, while the second metallic meshes 29*a* and 29*b* are sized with 100 meshes. In reference to FIG. 4 and FIG. 5, the first metallic meshes 28*a* and 28*b* preferably have a first orientation angle formed therebetween, whereby the first metallic meshes 28*a* and 28*b* stacked with each other at different orientations. Similarly, the second metallic meshes 29*a* and 29*b* have a second orientation angle formed therebetween, whereby the second metallic meshes 29*a* and 29*b* stacked with each other at different orientations. For example, the first orientation angle and the second orientation angle can be about 45 degrees. During manufacturing, the meshes can be integrated into the micro-structure layer by treating them with a diffusion bonding process. Similarly, the first metallic meshes 28*a* and 28*b* and the second metallic meshes 29*a* and 29 can be made of copper or aluminum.

Figure 7:
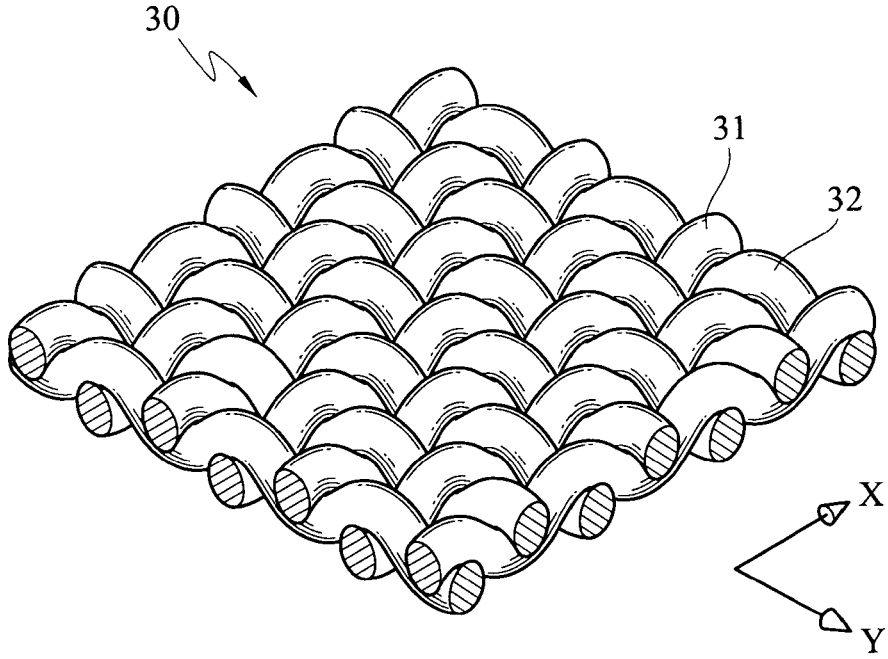
FIG. 7 is a schematic view illustrating the micro-structure of the present invention.
Figure 8:
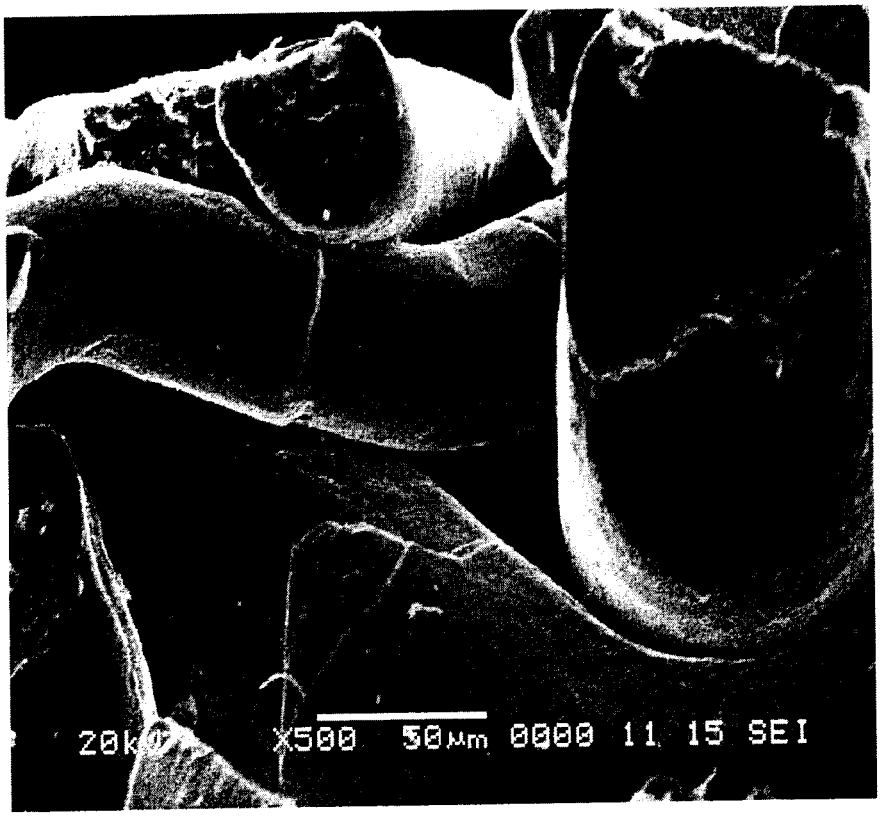
FIG. 8 is a micrograph showing the micro-structure of the present invention.

The present invention further discloses a micro-structure 30 comprising a plurality of first metallic wires 31 and a plurality of second metallic wires 32 which are interlaced as shown in FIG. 7. The first metallic wires 31 are arranged along a first orientation X, while the second metallic wires 32 are arranged along a second orientation Y. Particularly, the first orientation X is substantially perpendicular to the second orientation Y. Certainly, the first metallic wires 31 and the second metallic wires 32 can be copper, aluminum, or any other metal with high conductivity. In reference to FIG. 8, a micrograph of the micro-structure 30 of the present invention is shown. The first metallic wires 31 and the second metallic wires 32 are combined with each other through diffusion bonding to form the micro-structure 30.

In view of the abovementioned disclosures, the heat spreader of the present invention comprises at least one mesh to form the micro-structure layer therein by diffusion bonding. The heat spreader not only enhances the capillarity but also reduces the flowing resistance. In other words, the inverse relationship between the capillarity and the flowing resistance in the convention can be resolved.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A heat spreader, comprising:

a casing, having an inner surface, which comprises a vaporization area, a condensation area and a transportation area, and defining a sealed chamber therein;

a micro-structure layer formed on the inner surface of the casing, the micro-structure layer comprising a first structure layer formed by at least one first metallic mesh and a second structure layer formed by at least one second metallic mesh, wherein meshes of the at least one second metallic mesh are smaller than meshes of the at least one first metallic mesh, whereby cavities of the second structure layer are smaller than cavities of the first structure layer;

a support device disposed in the sealed chamber for supporting the casing; and a working fluid, being vaporized at the vaporization area and condensed at the condensation area to circulate from the condensation area to the vaporization area in the sealed chamber;

wherein the at least one first metallic mesh forms the first structure layer on the inner surface and the at least one second metallic mesh forms the second structure layer being stacked onto the first structure layer and corresponding to the vaporization area through diffusion bonding that the working fluid can circulate within the micro-structure layer by capillarity.

2. The heat spreader as claimed in claim 1, wherein the first structure layer is formed by a plurality of first metallic meshes through diffusion bonding.

3. The heat spreader as claimed in claim 2, wherein the first metallic meshes have a first orientation angle formed therebetween, whereby the first metallic meshes stacked with each other at different orientations.

4. The heat spreader as claimed in claim 2, wherein the first metallic meshes are formed by the material selected from the group consisting of: copper and aluminum.

5. The heat spreader as claimed in claim 3, wherein the first orientation angle is about 45 degrees.

6. The heat spreader as claimed in claim 1, wherein the second structure layer is formed by a plurality of second metallic meshes through diffusion bonding.

7. The heat spreader as claimed in claim 6, wherein the second metallic meshes have a second orientation angle formed therebetween, whereby the second metallic meshes stacked with each other at different orientations.

8. The heat spreader as claimed in claim 6, wherein the second metallic meshes are formed by the material selected from the group consisting of: copper and aluminum.

9. The heat spreader as claimed in claim 7, wherein the second orientation angle is about 45 degrees.

10. The heat spreader as claimed in claim 1, wherein the at least one first metallic mesh and the at least one second metallic mesh stack with each other at different orientations.

11. The heat spreader as claimed in claim 1, wherein the micro-structure layer further comprises a sintered layer, which is formed by metallic sintered particles.

12. The heat spreader as claimed in claim 1, wherein the micro-structure layer further comprises a roughened structure which is formed by a roughened process.

13. The heat spreader as claimed in claim 12, wherein the roughened process is selected from the group consisting of: grooving, sand blasting and chemical etching.

14. The heat spreader as claimed in claim 1, wherein the casing is formed by the material selected from the group consisting of: copper and aluminum.

15. The heat spreader as claimed in claim 1, wherein the at least one first metallic mesh is formed by the material selected from the group consisting of: copper and aluminum.

16. The heat spreader as claimed in claim 1, wherein the at least one second metallic mesh is formed by the material selected from the group consisting of: copper and aluminum.

17. The heat spreader as claimed in claim 1, wherein the support device comprises a plurality of columns which connects with the inner surface through diffusion bonding.

18. The heat spreader as claimed in claim 17, wherein the columns are formed by the material selected from the group consisting of: copper and aluminum.

19. The heat spreader as claimed in claim 1, wherein the casing comprises an upper cover and a lower cover connecting with each other through diffusion bonding.

* * * * *